US006017112A

United States Patent [19]

Anderson et al.

[11] Patent Number: 6,017,112

[45] Date of Patent: Jan. 25, 2000

[54] INK JET PRINTING APPARATUS HAVING A PRINT CARTRIDGE WITH PRIMARY AND SECONDARY NOZZLES

[75] Inventors: Frank Edward Anderson, Sadieville; John Philip Bolash, Lexington; Thomas Jon Eade, Lexington; Lawrence Russell Steward, Lexington, all of Ky.

[73] Assignee: Lexmark International, Inc., Lexington, Ky.

[21] Appl. No.: 08/964,282

[22] Filed: Nov. 4, 1997

[51] Int. Cl.[7] ..... B41J 2/145; B41J 2/15; B41J 23/00

[52] U.S. Cl. ..... 347/40; 347/41; 347/37

[58] Field of Search ..... 347/40, 41, 37

[56] References Cited

U.S. PATENT DOCUMENTS

| | | | |
|---|---|---|---|
| 4,097,873 | 6/1978 | Martin | 347/3 |
| 4,593,295 | 6/1986 | Matsufuji et al. | 347/41 |
| 4,750,009 | 6/1988 | Yoshimura | 347/43 |
| 4,812,859 | 3/1989 | Chan et al. | 347/63 |
| 5,124,720 | 6/1992 | Schantz | 347/19 |
| 5,208,605 | 5/1993 | Drake | 347/15 |
| 5,327,166 | 7/1994 | Shimada | 347/183 |
| 5,344,079 | 9/1994 | Tasaki et al. | 239/498 |
| 5,349,375 | 9/1994 | Bolash et al. | 347/40 |
| 5,359,355 | 10/1994 | Nagoshi et al. | 347/9 |
| 5,398,053 | 3/1995 | Hirosawa et al. | 347/13 |
| 5,412,406 | 5/1995 | Fujimoto | 347/180 |
| 5,412,410 | 5/1995 | Rezanka | 347/15 |
| 5,426,457 | 6/1995 | Raskin | 347/37 |
| 5,428,380 | 6/1995 | Ebisawa | 347/35 |
| 5,469,198 | 11/1995 | Kadonaga | 347/41 |
| 5,473,351 | 12/1995 | Helterline et al. | 347/19 |
| 5,480,240 | 1/1996 | Bolash et al. | 400/124.01 |
| 5,486,848 | 1/1996 | Ayata et al. | 347/15 |
| 5,488,397 | 1/1996 | Nguyen et al. | 347/40 |
| 5,559,930 | 9/1996 | Cariffe et al. | 395/102 |
| 5,581,284 | 12/1996 | Hermanson | 347/43 |
| 5,587,730 | 12/1996 | Karz | 347/43 |
| 5,598,192 | 1/1997 | Burger et al. | 347/43 |
| 5,627,572 | 5/1997 | Harrington, III et al. | 347/23 |
| 5,631,746 | 5/1997 | Overall et al. | 358/448 |
| 5,790,150 | 8/1998 | Lidke et al. | 347/41 |
| 5,825,377 | 10/1998 | Gotoh et al. | 347/15 |

FOREIGN PATENT DOCUMENTS

| | | | |
|---|---|---|---|
| 554907 | 8/1993 | European Pat. Off. | B41J 2/15 |
| 709212 | 5/1996 | European Pat. Off. . | |

*Primary Examiner*—N. Le
*Assistant Examiner*—Thinh Nguyen
*Attorney, Agent, or Firm*—Jacqueline M. Daspit; Robert L. Showalter

[57] ABSTRACT

An ink jet printing apparatus is provided comprising a print cartridge including a heater chip and a nozzle plate coupled to the heater chip. The heater chip has first, second, third and fourth heating elements, and the nozzle plate has a plurality of primary and secondary nozzles. The primary nozzles include first and second nozzles positioned in first and second nozzle plate columns and the secondary nozzles include third and fourth nozzles positioned in third and fourth nozzle plate columns. Each of the nozzles has one of the heating elements associated therewith for generating energy to discharge ink therefrom. The apparatus further includes a driver circuit, electrically coupled to the print cartridge, for applying firing pulses to the heating elements.

30 Claims, 10 Drawing Sheets

INK JET PRINTING APPARATUS HAVING A PRINT CARTRIDGE WITH PRIMARY AND SECONDARY NOZZLES

CROSS REFERENCE TO RELATED APPLICATIONS

This application is related to contemporaneously filed U.S. patent application Ser. No. 08/964,478, entitled "INK JET PRINTING APPARATUS HAVING PRIMARY AND SECONDARY NOZZLES," by Frank E. Anderson, and U.S. patent application Ser. No. 08/964,362, entitled "INK JET PRINTING APPARATUS HAVING REDUNDANT NOZZLES," by Frank E. Anderson, which are incorporated herein by reference.

FIELD OF THE INVENTION

This invention relates to ink jet printing apparatuses having at least one print cartridge with primary and secondary nozzles.

BACKGROUND OF THE INVENTION

Drop-on-demand ink let printers form a printed image by printing a pattern of individual dots or pixels on a print medium, such as a sheet of paper. The possible locations for the dots can be represented by an array or grid of pixels or square areas arranged in a rectilinear array of rows and columns wherein the center to center distance or dot pitch between pixels is determined by the resolution of the printer. The dots are printed as a printhead moves across the medium in a line scan direction. Between line scans, a stepper motor moves the print medium in a direction transverse to the line scan direction.

Drop-on-demand ink jet printers use thermal energy to produce a vapor bubble in an ink-filled chamber to expel a droplet. A thermal energy generator or heating element, usually a resistor, is located in the chamber on a heater chip near a discharge nozzle. A plurality of chambers, each provided with a single heating element, are provided in the printer's printhead. The printhead typically comprises the heater chip and a nozzle plate having a plurality of the discharge nozzles formed therein. The printhead forms part of an ink jet print cartridge which also comprises an ink-filled container.

In one conventional printhead, discharge nozzles are arranged in two columns, with tie nozzles of one column staggered relative to the nozzles of the other column. During use, the two columns function as a single column. Hence, each horizontal row of dots is printed by only a single nozzle. If a nozzle fails, the printed document will include horizontal blank lines where ink is absent due to the defective nozzle not printing dots along those lines.

Printer manufacturers are constantly searching for techniques which may be used to improve printing speed. One known technique involves adding additional nozzles to each nozzle column on the printhead. However, as nozzle column length increases, proper nozzle alignment along the columns becomes more critical. This is because print misalignment resulting from nozzle misalignment becomes more noticeable as nozzle column length increases.

An improved printhead which allows for increased printing speed and improved print quality is desired.

SUMMARY OF THE INVENTION

In accordance with the present invention, an ink jet printing apparatus is provided having a printhead with a plurality of primary and secondary nozzles. The primary nozzles include first and second nozzles positioned in first and second nozzle plate columns. The secondary nozzles include third and fourth nozzles positioned in third and fourth nozzle plate columns. The secondary nozzles define redundant nozzles. That is, each secondary nozzle shares a horizontal axis with a primary nozzle. Thus, instead of having two columns of nozzles, which function as a single vertical line of nozzles, printing a swath of data during a single pass of the printhead, there are four columns of nozzles, which function as two vertical lines of nozzles, printing the data. Each vertical line of nozzles is capable of printing approximately one-half of the pixels printed during a given pass of the printhead across the print medium. If a primary nozzle falls and its associated secondary nozzle is operable, only one-half of the data to be printed by the nozzle pair will not be printed. Hence, by using redundant nozzles, the likelihood that completely blank horizontal lines on the print medium will result is substantially reduced. Increased printing speed and an increase in nozzle life also result due to the addition of secondary nozzles. Further, by adding redundant nozzles, nozzle column length has not been substantially increased. This is an advantage as print misalignment resulting from nozzle misalignment becomes more noticeable as nozzle column length increases.

DETAILED DESCRIPTION OF THE PREFERRED EMBODIMENTS

Figure 1:
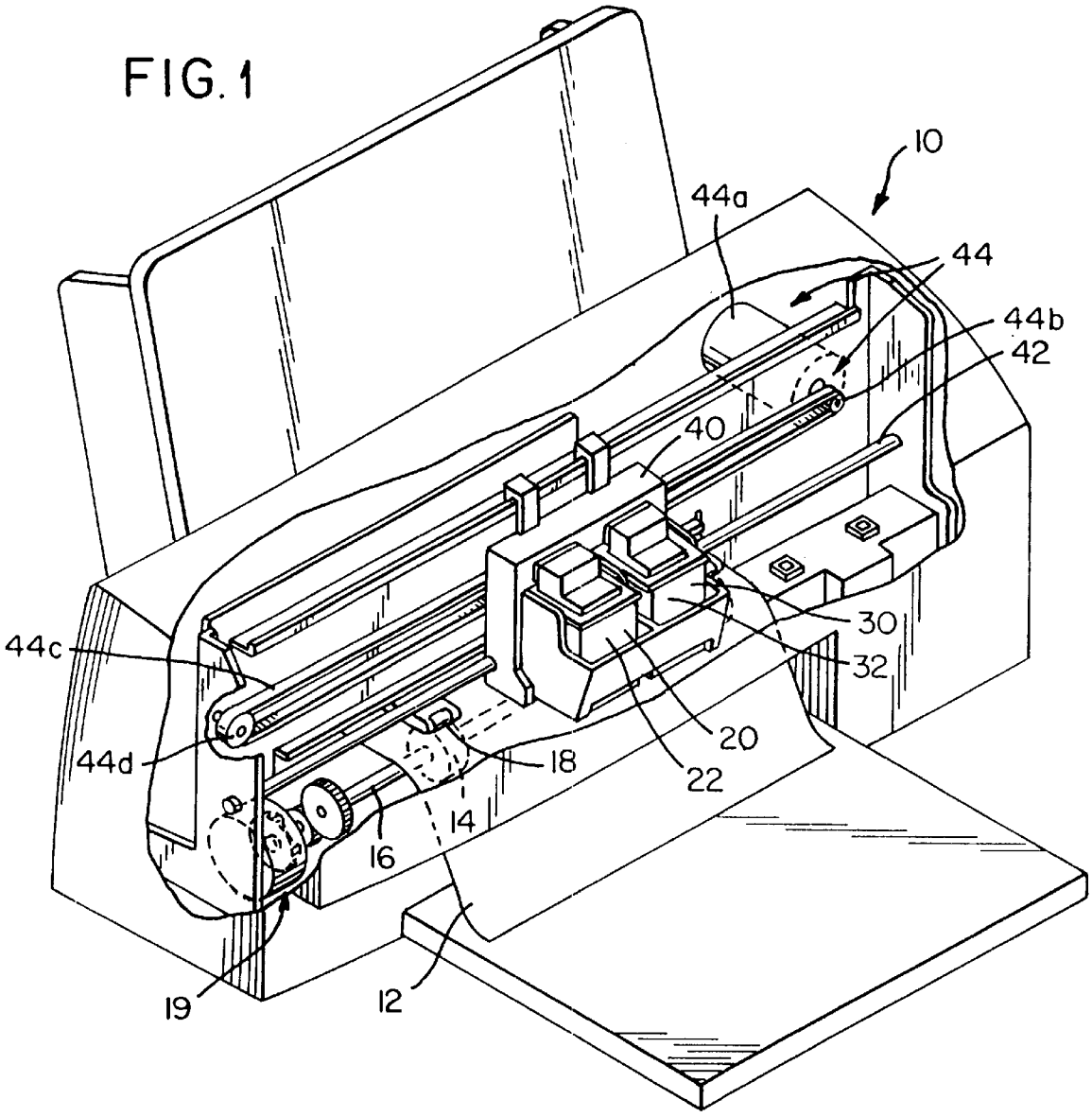
FIG. 1 is a perspective view of an ink jet printing apparatus having first and second print cartridges constructed in accordance with the present invention.

Referring now to FIG. 1, there is shown an ink jet printing apparatus 10 having first and second print cartridges 20 and 30 constructed in accordance with the present invention. The cartridges 20 and 30 are supported in a carrier 40 which, in turn, is slidably supported on a guide rail 42. A print cartridge drive mechanism 44 is provided for effecting reciprocating movement of the carrier 40 back and forth along the guide rail 42. The drive mechanism 44 includes a motor 44*a* with a drive pulley 44*b* and a drive belt 44*c* which extends about the drive pulley 44*b* and an idler pulley 44*d*. The carrier 40 is fixedly connected to the drive belt 44*c* so as to move with the drive belt 44*c*. Operation of the motor 44*a* effects back and forth movement of the drive belt 44*c* and, hence, back and forth movement of the carrier 40 and the print cartridges 20 and 30. As the print cartridges 20 and 30 move back and forth, they eject ink droplets onto a paper substrate 12 provided below them. Driven rollers 14 (only one is illustrated in FIG. 1) mounted on a shaft 16 cooperate with pressure rollers 18 (only one of which is illustrated in FIG. 1) to advance the paper substrate 12 in a direction generally orthogonal to the direction of print cartridge movement. The shaft 16 is driven by a stepper motor assembly 19.

Figure 2:
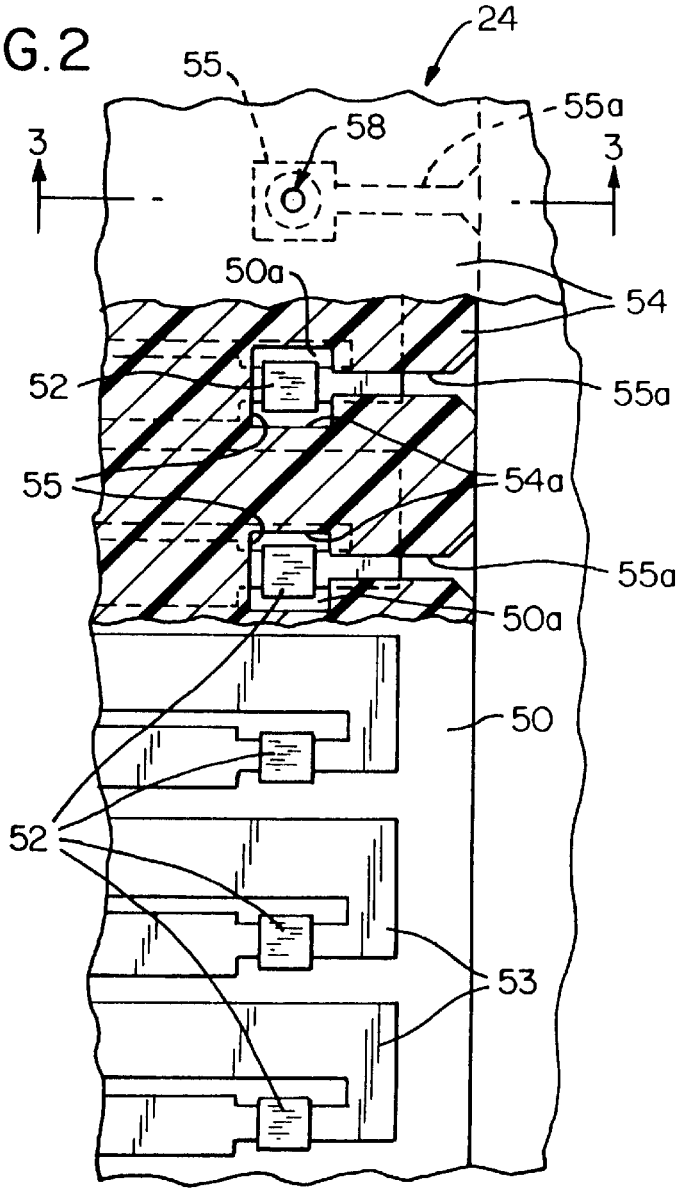
FIG. 2 is a view of a portion of a heater chip coupled to an nozzle plate with sections of the nozzle plate removed at two different levels.
Figure 3:
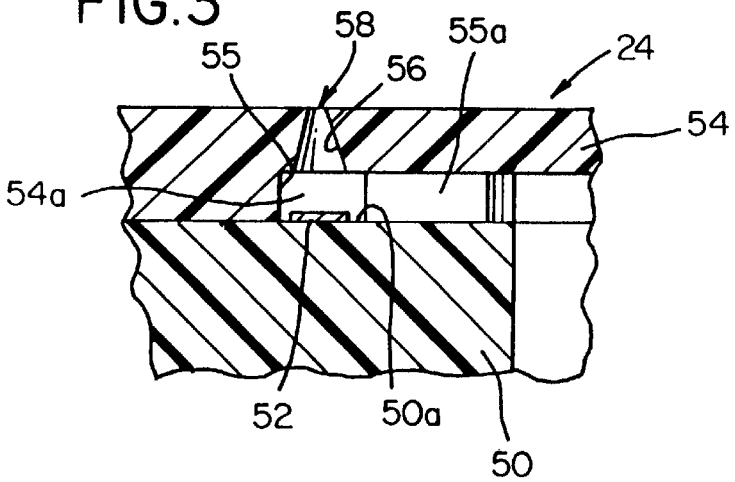
FIG. 3 is a view taken along section line 3—3 in FIG. 2.

The print cartridge 20 comprises a polymeric container 22, see FIG. 1, filled with ink and a printhead 24, see FIGS. 2 and 3. The printhead 24 comprises a heater chip 50 having a plurality of resistive heating elements 52. The printhead 24 further includes a nozzle plate 54 having a plurality of openings 56 extending through it which define a plurality of nozzles 58 through which ink droplets are ejected. The diameter of each nozzle 58 is from about 5 microns to about 29 microns.

The nozzle plate 54 may be formed from a flexible polymeric material substrate which is adhered to the heater chip 50 via an adhesive (not shown). Examples of polymeric materials from which the nozzle plate 54 may be formed and adhesives for securing the plate 54 to the heater chip 50 are set out in commonly assigned patent application, U.S. Ser. No. 08/519,906, entitled "METHOD OF FORMING AN INKJET PRINTHEAD NOZZLE STRUCTURE," by Tonya H. Jackson et al., filed on Aug. 28, 1995, Attorney Docket No. LE9-95-024, the disclosure of which is hereby incorporated by reference. As noted therein, the plate 54 may be formed from a polymeric material such as polyimide, polyester, fluorocarbon polymer, or polycarbonate. The plate 54 is preferably about 15 to about 200 microns thick, and most preferably about 50 to about 125 microns thick. Examples of commercially available plate materials include a polyimide material available from E.I. DuPont de Nemours & Co. under the trademark "KAPTON" and a polyimide material available from Ube (of Japan) under the trademark "UPILEX."

The plate 54 may be bonded to the chip 50 via any art recognized technique, including a thermocompression bonding process. When the plate 54 and the heater chip 50 are joined together, sections 54*a* of the plate 54 and portions 50*a* of the heater chip 50 define a plurality of bubble chambers 55. Ink supplied by the container 22 flows into the bubble chambers 55 through ink supply channels 55*a*. The resistive heating elements 52 are positioned on the heater chip 50 such that each bubble chamber 55 has only one heating element 52. Each bubble chamber 55 communicates with one nozzle 58, see FIG. 3.

Figure 7:
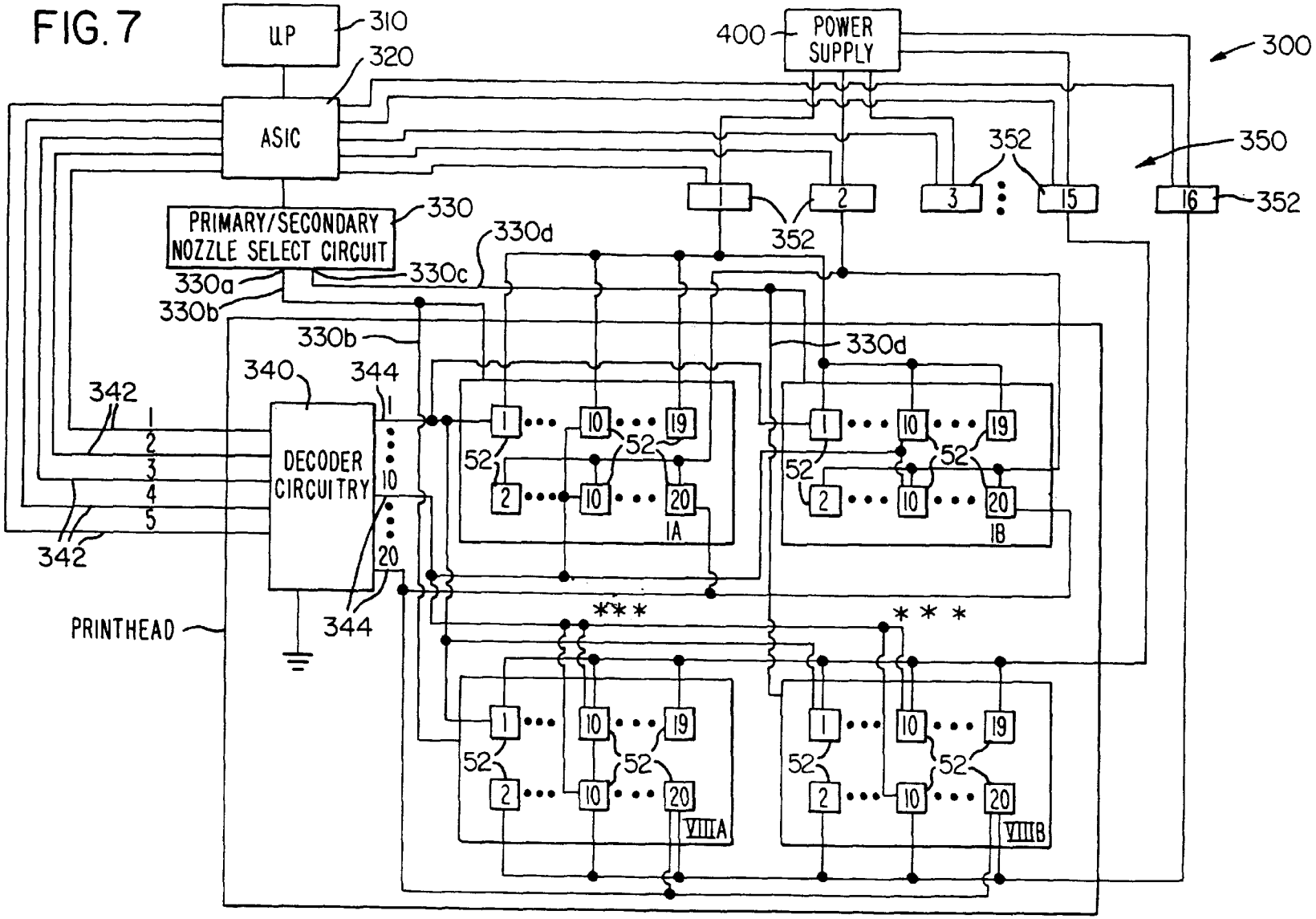
FIG. 7 is a schematic diagram illustrating the driver circuit of the present invention.

The resistive heating elements 52 are individually addressed by voltage pulses provided by a driver circuit 300, see FIG. 7. Each voltage pulse is applied to one of the heating elements 52 to momentarily vaporize the ink in contact with that heating element 52 to form a bubble within the bubble chamber 55 in which the heating element 52 is found. The function of the bubble is to displace ink within the bubble chamber 55 such that a droplet of ink is expelled from a nozzle 58 associated with the bubble chamber 55.

A flexible circuit (not shown) secured to the polymeric container 22 is used to provide a path for energy pulses to travel from the driver circuit 300 to the heater chip 50. Bond pads (not shown) on the heater chip 50 are bonded to end sections of traces (not shown) on the flexible circuit. Current flows from the circuit 300 to the traces on the flexible circuit and from the traces to the bond pads on the heater chip 50. The current then flows from the bond pads along conductors 53 to the heating elements 52.

The print cartridge 30 comprises a polymeric container 32, see FIG. 1, filled with ink and a printhead (not shown). The printhead of the print cartridge 30 is constructed in essentially the same manner as the printhead 24 and, as such, will not be described in further detail herein.

Figure 4:
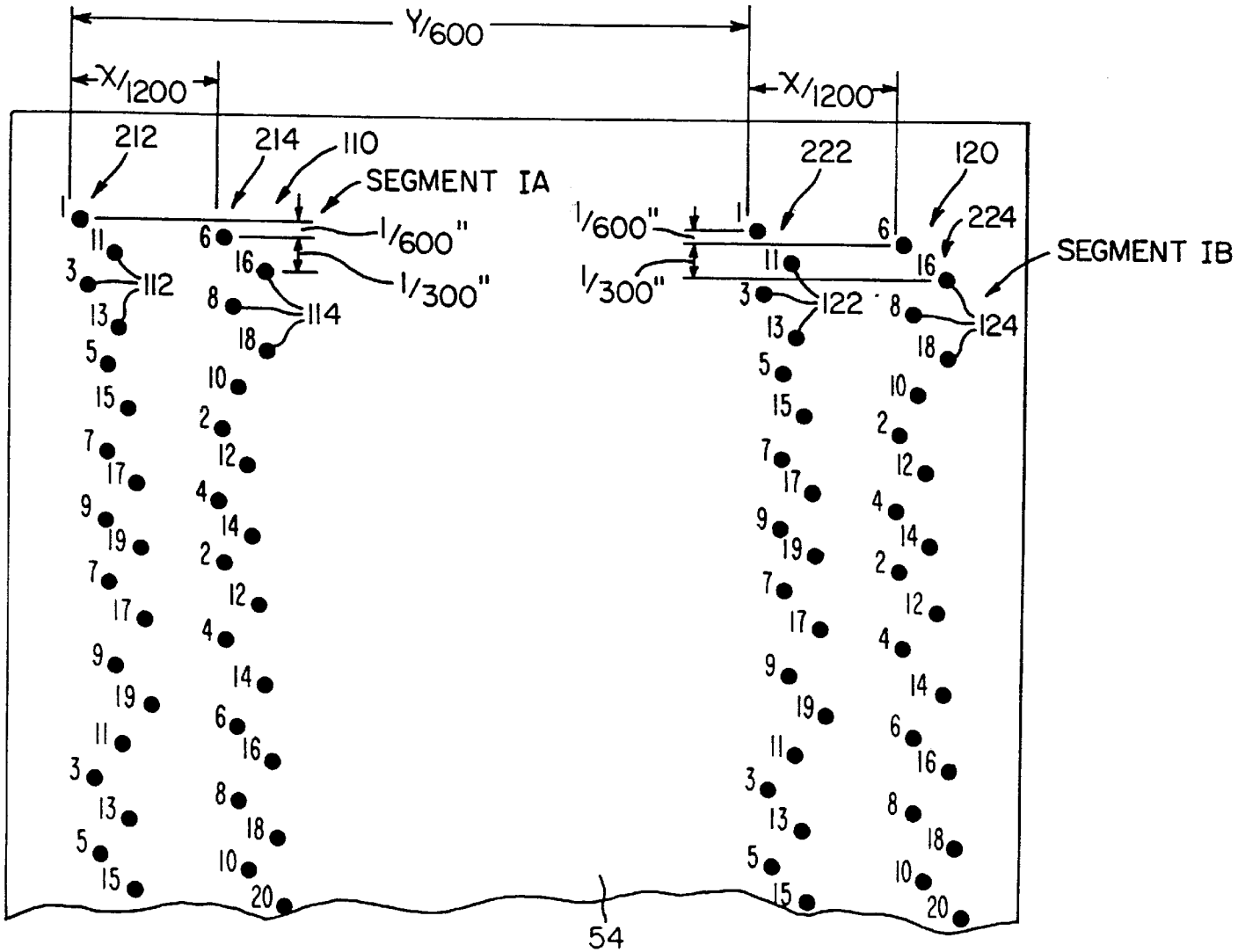
FIG. 4 is a schematic illustration of a portion of a nozzle plate with first and second nozzles of segment IA and third and fourth nozzles of segment IB represented by solid dots.
Figure 5:
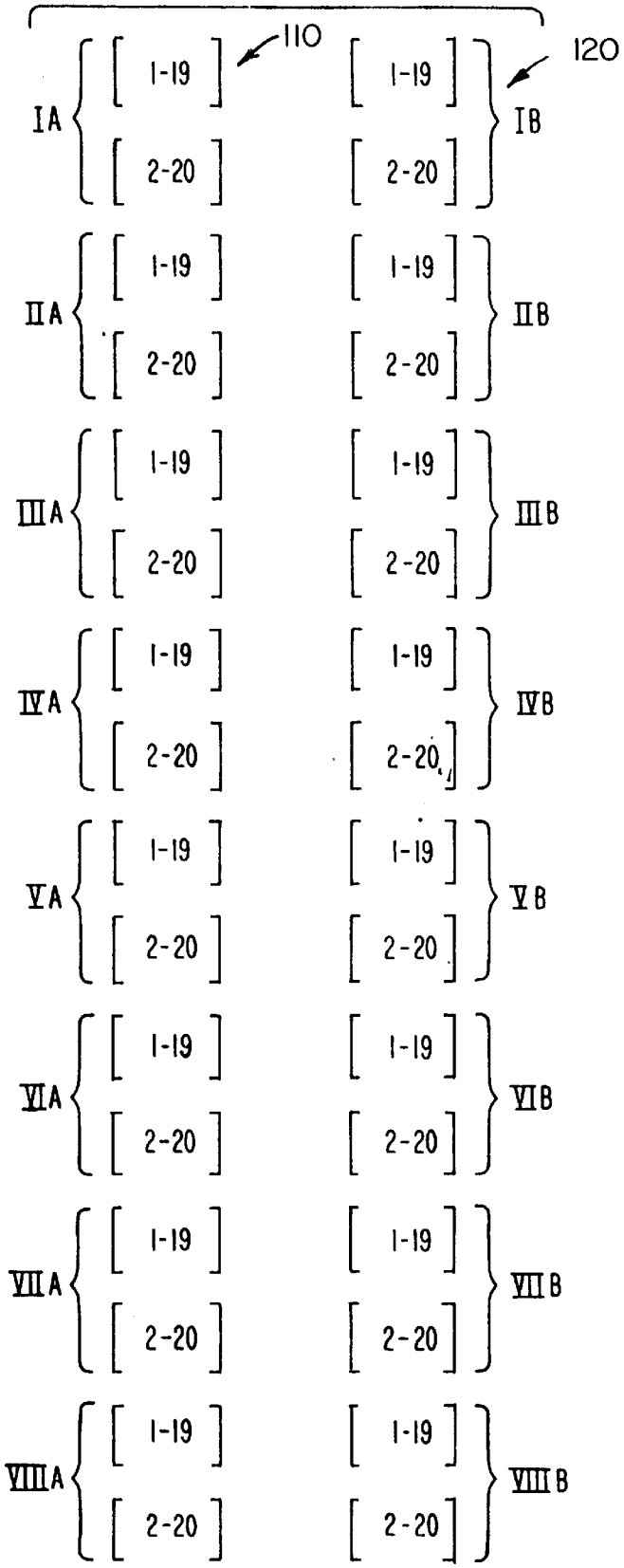
FIG. 5 is an illustration of a nozzle plate with primary and secondary nozzles of segments IA–VIIIA and segments IB–VIIIB numerically designated.

In accordance with the present invention, the nozzle plate 54 is provided with a plurality of primary nozzles 110 and secondary nozzles 120, see FIG. 4. In the illustrated embodiment, there are eight segments IA–VIIIA of primary nozzles 110, each segment having 38 nozzles, as represented in FIG. 5. Thus, the total number of primary nozzles 110, in the illustrated embodiment, equals 304 nozzles. Similarly, there are eight segments IB–VIIIB of secondary nozzles 120, each segment having 38 nozzles. The total number of secondary nozzles 120 equals 304 nozzles. Each secondary nozzle 120 shares a horizontal axis with a primary nozzle 110. The specific number of primary and secondary nozzles 110 and 120 formed on the nozzle plate 54 are mentioned herein for illustrative purposes only. Hence, the number of primary and secondary nozzles 110 and 120 are not intended to be limited to those represented in FIG. 5.

Figure 6:
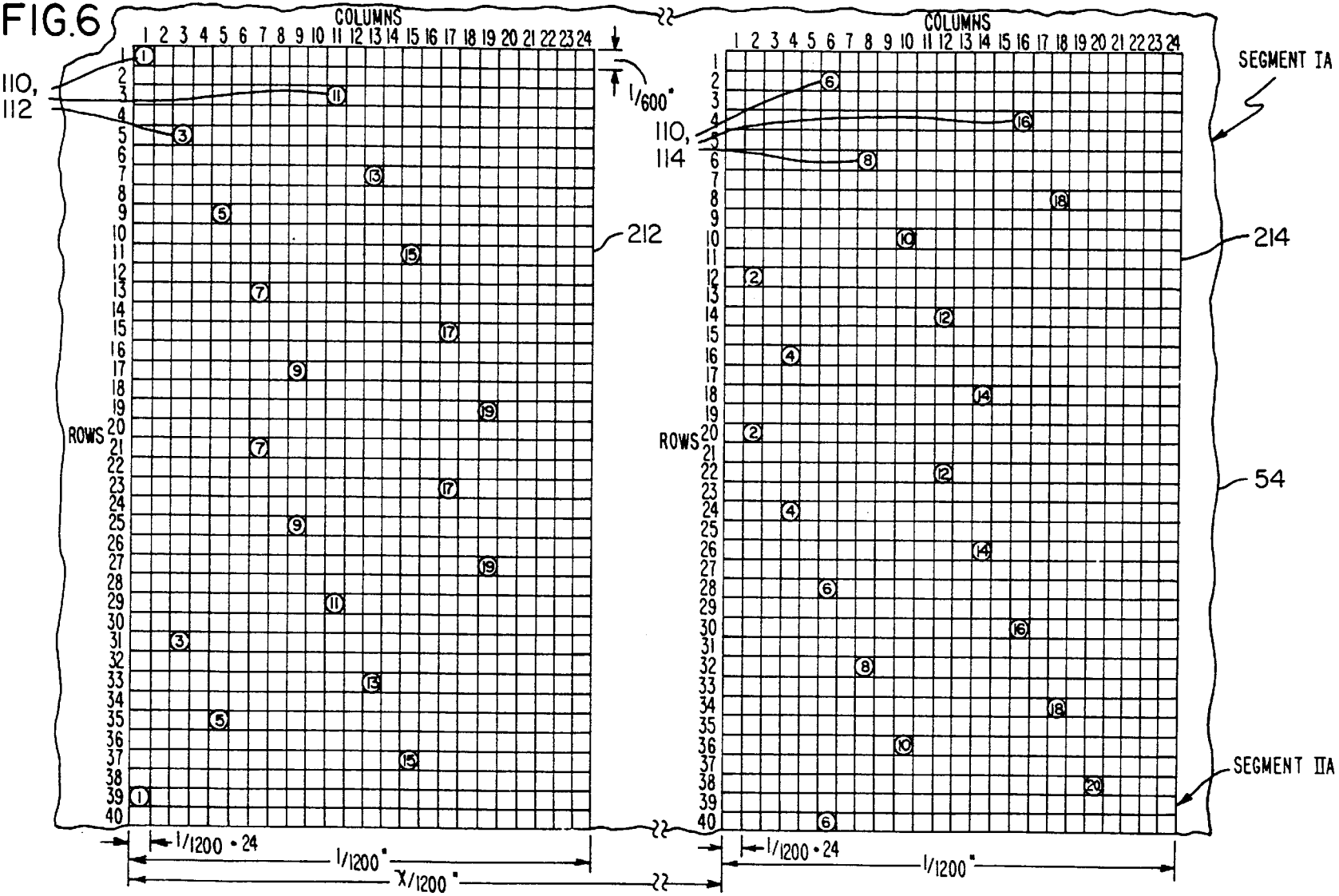
FIG. 6 is an illustration of a portion of a nozzle plate with first and second nozzles of segment IA and two nozzles of segment IIA represented by numbered circles.

The primary nozzles 110 include first and second nozzles 112 and 114 positioned in first and second nozzle plate columns 212 and 214, see FIGS. 4 and 6. The secondary nozzles 120 include third and fourth nozzles 122 and 124 positioned in third and fourth nozzle plate columns 222 and 224, see FIG. 4. Front sections of the first and second columns 212 and 214 are spaced apart from one another by a distance equal to $X/1200$ inch, wherein X is an odd integer $\geqq 3$ and $\leqq 9$, see FIGS. 4 and 6. Front sections of the third and fourth columns 222 and 224 are spaced apart from one another by a distance equal to $X/1200$ inch, wherein X is an odd integer $\geqq 3$ and $\leqq 9$, see FIG. 4. Front sections of the first and third columns 212 and 222 are spaced apart from one another by a distance equal to $Y/600$ inch, wherein Y is an even integer $\geqq 40$, see FIG. 4. In the illustrated embodiment, X=5 and Y=86.

The first and second nozzles 112 and 114 of segment IA and the third and fourth nozzles 122 and 124 of segment IB are represented in FIG. 4 by solid dots with numbers positioned adjacent to the dots. The first and second nozzles 112 and 114 of segment IA and two nozzles of segment IIA are Illustrated in FIG. 6 by numbered circles. The first nozzles 112 are represented by odd-numbered circles and the second nozzles 114 are represented by even-numbered circles. The 38 nozzles of each of segments IA and IB are numbered 1–19 and 2–20 in FIGS. 4–6.

The vertical distance between center points of adjacent first and second nozzles 112 and 114 positioned in adjacent horizontal rows in the columns 212 and 214, e.g., nozzles 1 and 6 located in rows 1 and 2, is approximately $1/600$ inch, see FIGS. 4 and 6. The vertical distance between center points of adjacent third and fourth nozzles 122 and 124 positioned in adjacent horizontal rows in the third and fourth columns 222 and 224, e.g., nozzles 1 and 6, is also about $1/600$ inch, see FIG. 4. The vertical distance between center points of vertically adjacent first nozzles 112, e.g., nozzles 1 and 11, is approximately $1/300$ inch. Similarly, the vertical distance between vertically adjacent second nozzles 114, third nozzles 122 and fourth nozzles 124 is approximately $1/300$ inch.

The numbers adjacent to the dots in FIG. 4 and within the circles in FIG. 6 designate vertical subcolumns within the nozzle plate columns 212 and 214 in which center points of the nozzles 112 and 114 are found. As indicated in FIG. 6, the width of each vertical subcolumn within each of the nozzle plate columns 212 and 214 is $1/28{,}800$ inch. Thus, the horizontal distance between the center points of two horizontally adjacent first nozzles 112, e.g. nozzles 1 and 3, is approximately $2/28{,}800$ inch. Similarly, the horizontal distance between the center points of two horizontally adjacent second nozzles 114, e.g., nozzles 2 and 4, is approximately $2/28{,}800$.

In the illustrated embodiment, the 38 nozzles of each of segments IIA–VIIIA ard segments IB–VIIIB are arranged in the same order and are spaced from another in the same manner as are the 38 nozzles of segment IA. Thus, the secondary nozzles 120 are arranged in the same order and spaced from one another in the same manner as the primary nozzles 110. Accordingly, the order and spacing of the secondary nozzles 120 will not be further described herein.

The driver circuit 300 comprises a microprocessor 310, an application specific integrated circuit (ASIC) 320, a primary nozzle/secondary nozzle select circuit 330, decoder circuitry 340 and a common drive circuit 350.

The primary nozzle/secondary nozzle select circuit 330 selectively enables either the primary nozzle segments IA–VIIIA or the secondary nozzle segments IB–VIIIB. It has a first output 330*a* which is electrically coupled to the primary nozzles 110 via conductor 330*b*. It also has a second output 330*c* which is electrically coupled to the secondary nozzles 120 via a conductor 330*d*. Thus, a first select signal present at the first output 330*a* is used to select the operation of the primary nozzles 110 while a second select signal present at the second output 330*c* is used to select the operation of the secondary nozzles 120. The primary nozzle/secondary nozzle select circuit 330 is electrically coupled to the ASIC 320 and generates appropriate select signals in response to command signals received from the ASIC 320.

As noted above, there is a single resistive heating element 52 associated with each of the primary and secondary nozzles 110 and 120. In FIG. 7, the illustrated resistive heating elements 52 are numbered and grouped so as to correspond with the nozzle numbering and segment groupings used in FIGS. 4–6.

The common drive circuit 350 comprises a plurality of drivers 352 which are electrically coupled to a power supply 400, the ASIC 320 and the resistive heating elements 52. In the illustrated embodiment, sixteen drivers 352 are provided. Each of the sixteen drivers 352 is electrically coupled to one-half of the heating elements 52 associated with one of the primary nozzle segments IA–VIIIA and one-half of the heating elements 52 associated with one of the secondary nozzle segments IB–VIIIB. In FIG. 7, the first driver 352, i.e., the driver designated number 1, is coupled to the heating elements 52 associated with the upper one-half of the nozzles 110 of the primary nozzle segment IA, i.e., the nozzles numbered 1–19 in FIGS. 4–6, and the heating elements 52 associated with the upper one-half of the nozzles 120 of the secondary nozzle segment IB. The second driver 352, i.e., the driver designated number 2, is coupled to the heating elements 52 associated with the lower one-half of the nozzles 110 of the primary nozzle segment IA, i.e., the nozzles numbered 2–20 in FIGS. 4–6, and the heating elements 52 associated with the lower one-half of the nozzles 120 of the secondary nozzle segment IB. The fifteenth driver 352, i.e., the driver designated number 15, is coupled to the heating elements 52 associated with the upper one-half of the nozzles 110 of the primary nozzle segment VIIIA, and the heating elements 52 associated with the upper one-half of the nozzles 120 of the secondary nozzle segment VIIIB. The sixteenth driver 352, i.e., the driver numbered 16, is coupled to the heating elements 52 associated with the lower one-half of the nozzles 110 of the primary nozzle segment VIIIA, and the heating elements 52 associated with the lower one-half of the nozzles 120 of the secondary nozzle segment VIIIB.

There are five input lines 342 extending from the ASIC 320 to the decoder circuitry 340. Twenty address lines 344 extend from the decoder circuitry 340 to the resistive heating elements 52. Each address line 344 extends to heating elements 52 associated with like numbered nozzles in each of the primary and secondary segments IA–VIIIA and IB–VIIIB. For example, the first address line 344, i.e., the address line numbered 1 in FIG. 7, is connected to the resistive heating elements 52 associated with the number 1 primary and secondary nozzles 110 and 120 in each of the primary and secondary segments IA–VIIIA and IB–VIIIB. The tenth address line 344, i.e., the address line numbered 10 in FIG. 7, is connected to the resistive heating elements 52 associated with the number 10 primary and secondary nozzles in each of the primary and secondary segments IA–VIIIA and IB–VIIIB. The twentieth address line 344, i.e., the address line numbered 20 in FIG. 7, is connected to the resistive heating elements 52 associated with the number 20 primary and secondary nozzles in each of the primary and secondary segments IA–VIIIA and IB–VIIIB. As will be discussed more explicitly below, the ASIC 320 sends appropriate signals to the decoder circuitry 340 such that during a given firing cycle, the decoder circuitry 340 generates appropriate address signals to the heating elements 52 associated with the primary and secondary nozzles 110 and 120.

Each driver 352 is only activated by the ASIC 320 when one of the heating elements 52 to which it is connected is to be fired. The specific heating elements 52 fired during a given firing cycle depends upon print data received by the microprocessor 310 from a separate processor (not shown) electrically coupled to it. The microprocessor 310 generates signals which are passed to the ASIC 320 and, in turn, the ASIC 320 generates appropriate firing signals which are passed to the sixteen drivers 352. The activated drivers 352 then apply firing voltage pulses to the heating elements 52 in conjunction with the ground path provided by the decoder circuitry 340.

If the heating element associated with the number 1 primary nozzle 110 in segment IA is to be fired during a given firing cycle segment, the first driver 352 will be activated simultaneously with the activation of the first output 330*a* of the select circuit 330 and the first address line 344. If the number 2 primary nozzle 110 in segment IA is not to be fired during a given firing cycle segment, the second driver 352 will not be fired when the first output 330*a* of the select circuit 330 and the second address line 344 are simultaneously activated. If the uppermost primary nozzle 110 numbered 10 in segment IA is to be fired, the first driver 352 will be fired when the first output 330*a* of the select circuit 330 and the tenth address line 344 are simultaneously activated. If the lowermost primary nozzle 110 numbered 10 in segment IA is not to be fired during a given firing cycle segment the second driver 352 will not be fired when the first output 330*a* of the select circuit 330 and the tenth address line 344 are simultaneously activated.

The printing apparatus 10 is selectively operable in one of a normal mode of operation and a high speed mode of operation. The user of the apparatus 10 may select the desired mode via software during printer set up.

Figure 8:
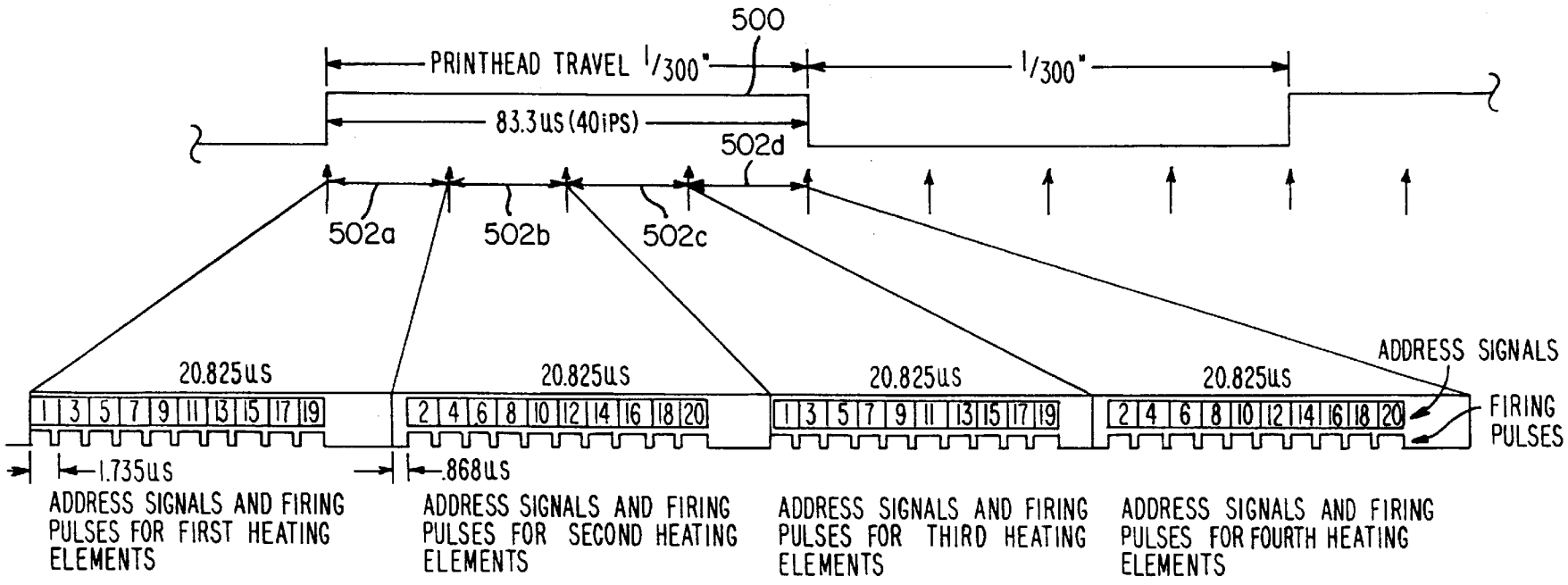
FIG. 8 is a timing diagram for high speed mode operation.

A timing diagram for the high speed mode of operation is illustrated in FIG. 8, wherein an expanded high speed mode firing cycle 500 is shown. The driver circuit 300 is capable of applying, depending upon print data received by the microprocessor 310 from the separate processor (not shown) electrically coupled to it, first firing pulses to first heating elements 52, i.e., the heating elements 52 associated with the first nozzles 112 (the od-numbered primary nozzles), during a first segment 502*a* of each high speed mode firing cycle, second firing pulses to second heating elements 52, i.e., the heating elements 52 associated with the second nozzles 114 (the even-numbered primary nozzles), during a second segment 502*b* of each high speed mode firing cycle, third firing pulses to third heating elements 52, i.e., the heating elements 52 associated with the third nozzles 122 (the odd-numbered secondary nozzles), during a third segment 502*c* of each high speed mode firing cycle, and fourth firing pulses to fourth heating elements 52, i.e., the heating elements 52 associated with the fourth nozzles 124 (the even-numbered secondary nozzles), during a fourth segment 502*d* of each high speed mode firing cycle.

As illustrated in FIG. 8, during the first and third segments 502*a* and 502*c* of each high speed mode firing cycle, the ASIC 320 causes the decoder circuitry 340 to cycle through its odd address lines 344. During the second and fourth segments 502*b* and 502*d* of each high speed mode firing cycle, the ASIC 320 causes the decoder circuitry 340 to cycle through its even address lines 344. The first output 330*a* is active only during the first and second segments 502*a* and 502*b*. The second output 330*c* is active only during the third and fourth segments 502*c* and 502*d*.

During the first segment 502*a* of the high speed mode firing cycle, the first output 330*a* is active and, depending upon the print data received by the microprocessor 310, the appropriate drivers 352 are activated as the decoder circuitry 340 cycles through its odd address lines 344 such that the desired first heating elements associated with the first nozzles 112 in segments IA–VIIIA are fired. During the second segment 502*b* of the high speed mode firing cycle, the first output 330*a* is active and, depending upon the print data received by the microprocessor 310, the appropriate drivers 352 are activated as the decoder circuitry 340 cycles through its even address lines 344 such that the desired second heating elements 52 associated with the second nozzles 114 in segments IA–VIIIA are fired. During the third segment 502*c* of the high speed mode firing cycle, the second output 330*c* is active and, depending upon the print data received by the microprocessor 310, the appropriate drivers 352 are activated as the decoder circuitry 340 cycles through its odd address lines 344 such that the desired third heating elements 52 associated with the third nozzles 122 in segments IB–VIIIB are fired. During the fourth segment 502*d* of the high speed mode firing cycle, the second output 330*c* is active and, depending upon the print data received by the microprocessor 310, the appropriate drivers 352 are activated as the decoder circuitry 340 cycles through its even address lines 344 such that the desired fourth heating elements 52 associated with the fourth nozzles 124 in segments IB–VIIIB are fired.

The length of time of each of the first, second, third and fourth segments 502*a*–502*d* of the high speed mode firing cycle is from about 12 μseconds to about 64 μseconds. The printhead speed is from about 13 inches/second to about 70 inches/second. In the illustrated embodiment, the length of time of each of the segments 502*a*–502*d* is about 20.825 seconds such that the total firing cycle time is approximately 83.3 μseconds. Further, the printhead speed is about 40 inches/second such that the printhead travels approximately 1/300 inch per firing cycle.

It is noted that at the beginning of each of the second and fourth segments 502*b* and 502*d* of the high speed mode firing cycle, a delay of about 0.868 μseconds occurs before the heating element 52 associated with the number 2 second nozzle 114 and the number 2 fourth nozzle 124 are fired. This delay period is equal to the amount of time it takes the printhead to move 1/28,800 inch, tie length of one subcolumn within each of the second and fourth columns 214 and 224.

Figure 9:
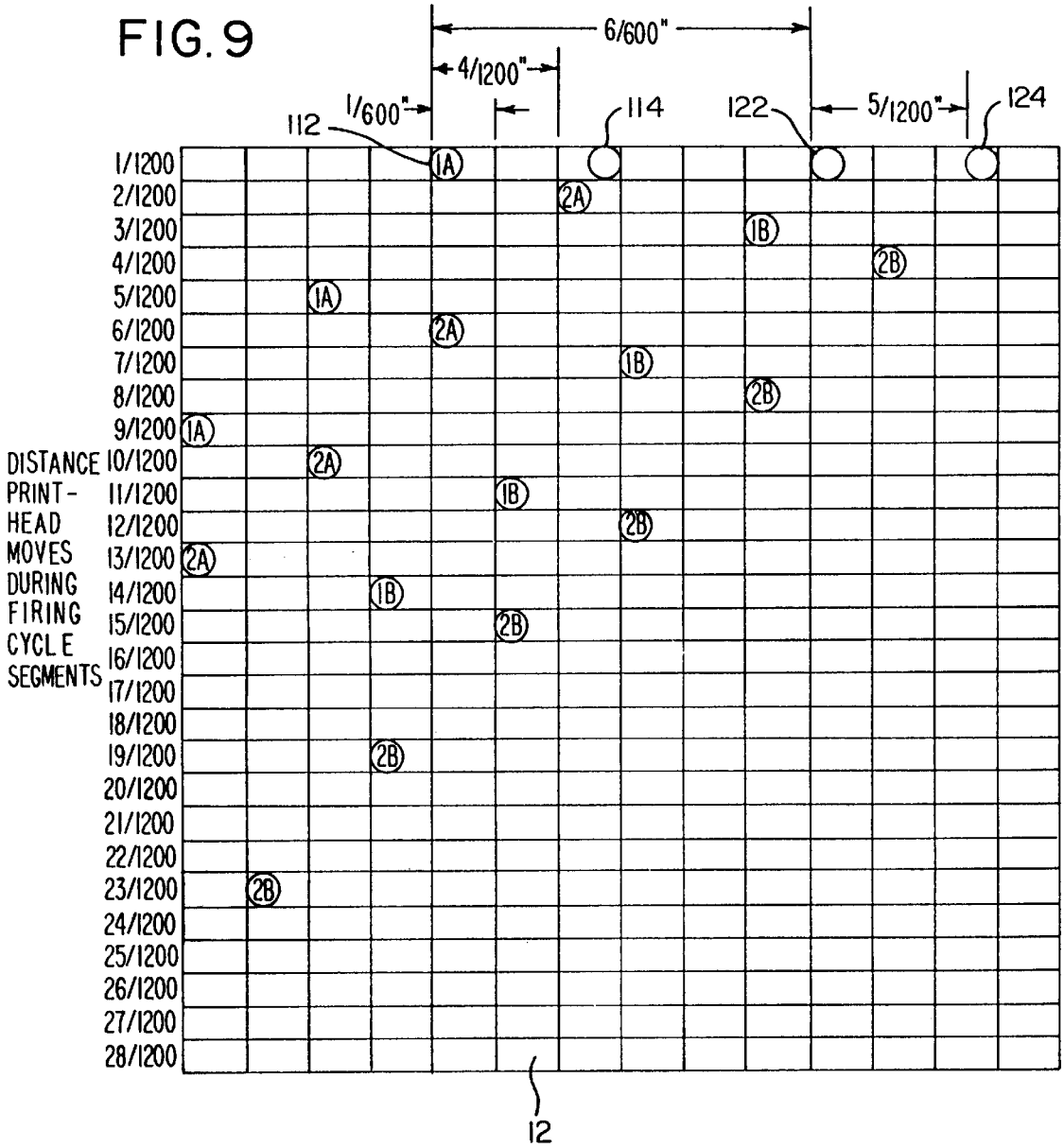
FIG. 9 is a plot showing dots generated by first, second, third and fourth nozzles during consecutive segments of high speed mode firing cycles.

In FIG. 9, a plot is illustrated showing dots generated by a first nozzle 112, a second nozzle 114, a third nozzle 122 and a fourth nozzle 124 during high speed mode operation. The initial positions of the nozzles 112, 114, 122 and 124 are shown. For illustrative purposes, the distance between the first and third nozzles 112 and 122 is 6/600 inch. Dots generated by the nozzles 112, 114, 122 and 124 are represented by numbered circles, wherein dots 1A are formed by the first nozzle 112, dots 2A are formed by the second nozzle 114, dots 18 are formed by the third nozzle 122 and dots 2B are formed by the fourth nozzle 124. As can be seen from FIG. 9, during a first segment 502*a* of a first high speed mode firing cycle, nozzle 112 is fired and the printhead moves a distance across the paper substrate 12 (from right to left) equal to 1/1200 inch. During a second segment 502*b* of the first high speed mode firing cycle, nozzle 114 is fired and the printhead moves another 1/1200 inch across the paper substrate 12. The dot 2A created by the nozzle 114 is horizontally spaced approximately 4/1200 inch from the dot 1A created by the nozzle 112. During a third segment 502*c* of the first high speed firing cycle, nozzle 122 is fired and the printhead moves another 1/1200 inch across the paper substrate 12. During a fourth segment 502*d* of the first high speed firing cycle, nozzle 124 is fired and the printhead moves another 1/1200 inch across the paper substrate 12. The dot 2B created by nozzle 124 is horizontally spaced approximately 4/1200 inch from the dot 1B created by the nozzle 122. As is apparent from FIG. 9, the dots are horizontally spaced from one another by a distance of 1/600 inch. Thus, 600 dots per inch horizontal resolution occurs during high speed mode printing. This results because the first and second columns 212 and 214 are spaced apart from one another by a distance equal to X/1200 inch, wherein X is an odd integer; the third and fourth columns are spaced apart from one another by a distance equal to X/1200 inch, wherein X is an odd integer; and the first and third columns are spaced apart from one another by a distance equal to Y/600 inch, wherein Y is an even integer.

Figure 10:
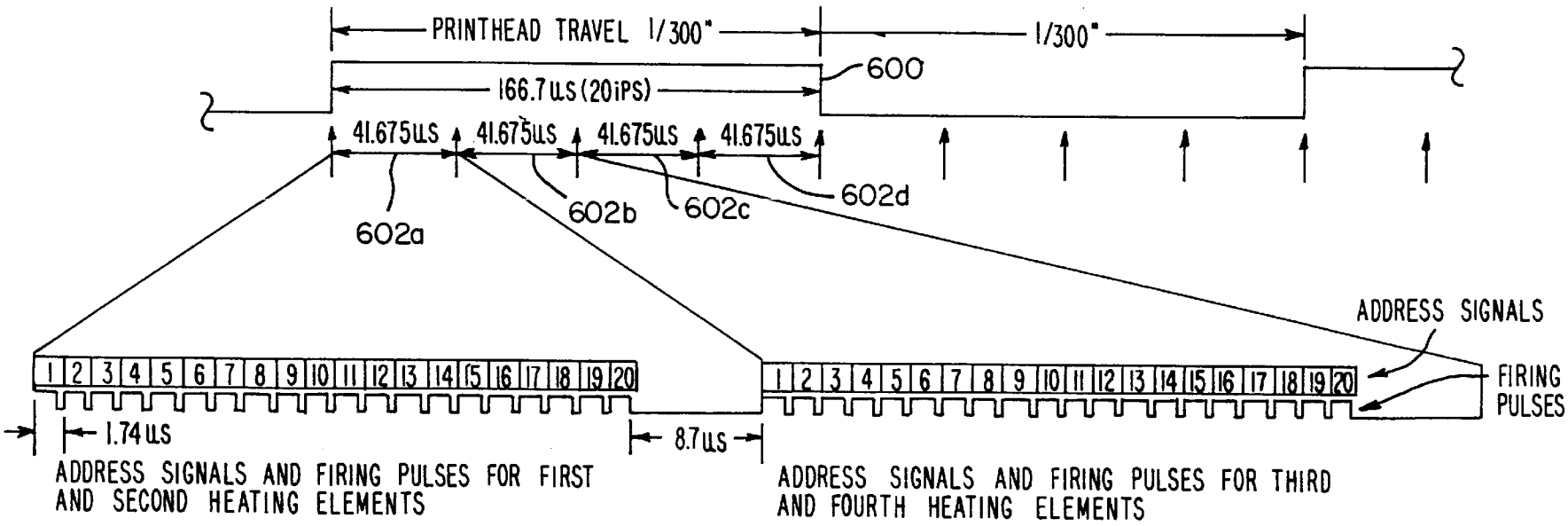
FIG. 10 is a timing diagram for normal speed mode operation.

A timing diagram for the normal speed mode of operation is illustrated in FIG. 10, wherein an expanded normal speed mode firing cycle 600 is shown. The driver circuit 300 is capable of alternatively applying, depending upon print data received by the microprocessor 310 from the separate processor (not shown) electrically coupled to it, first and second firing pulses to first and second heating elements 52, i.e., the heating elements 52 associated with the first and second nozzles 112 and 114, during a first segment 602*a* of each normal speed mode firing cycle; third and fourth firing pulses to third and fourth heating elements 52, i.e., the heating elements 52 associated with the third and fourth nozzles 122 and 124, during a second segment 602*b* of each normal speed mode firing cycle; first and second firing pulses to the first and second heating elements 52 during a third segment 602*c* of each normal speed mode firing cycle and third and fourth firing pulses to the third and fourth heating elements 52 during a fourth segment 602*d* of each normal speed mode firing cycle.

During each of the segments 602*a*–602*d* of the normal speed mode firing cycle, the ASIC 320 causes the decoder circuitry 340 to cycle through each of its twenty address lines 344. The first output 330*a* is active during the first and third segments 602*a* and 602*c* and the second output 330*c* is active during the second and fourth segments 602*b* and 602*d*.

The length of time of each of the first, second, third and fourth segments 602*a*–602*d* of the normal speed mode firing cycle is from about 24 μseconds to about 64 μseconds. The printhead speed is from about 13 inches/second to about 35 inches/second. In the illustrated embodiment, the length of time of each of the segments 602*a*–602*d* is about 41.675 μseconds such that the total firing cycle time is approximately 166.7 μseconds. Further, the printhead speed is about 20 inches/second such that the printhead travels approximately 1/300 inch per firing cycle.

Figure 11:
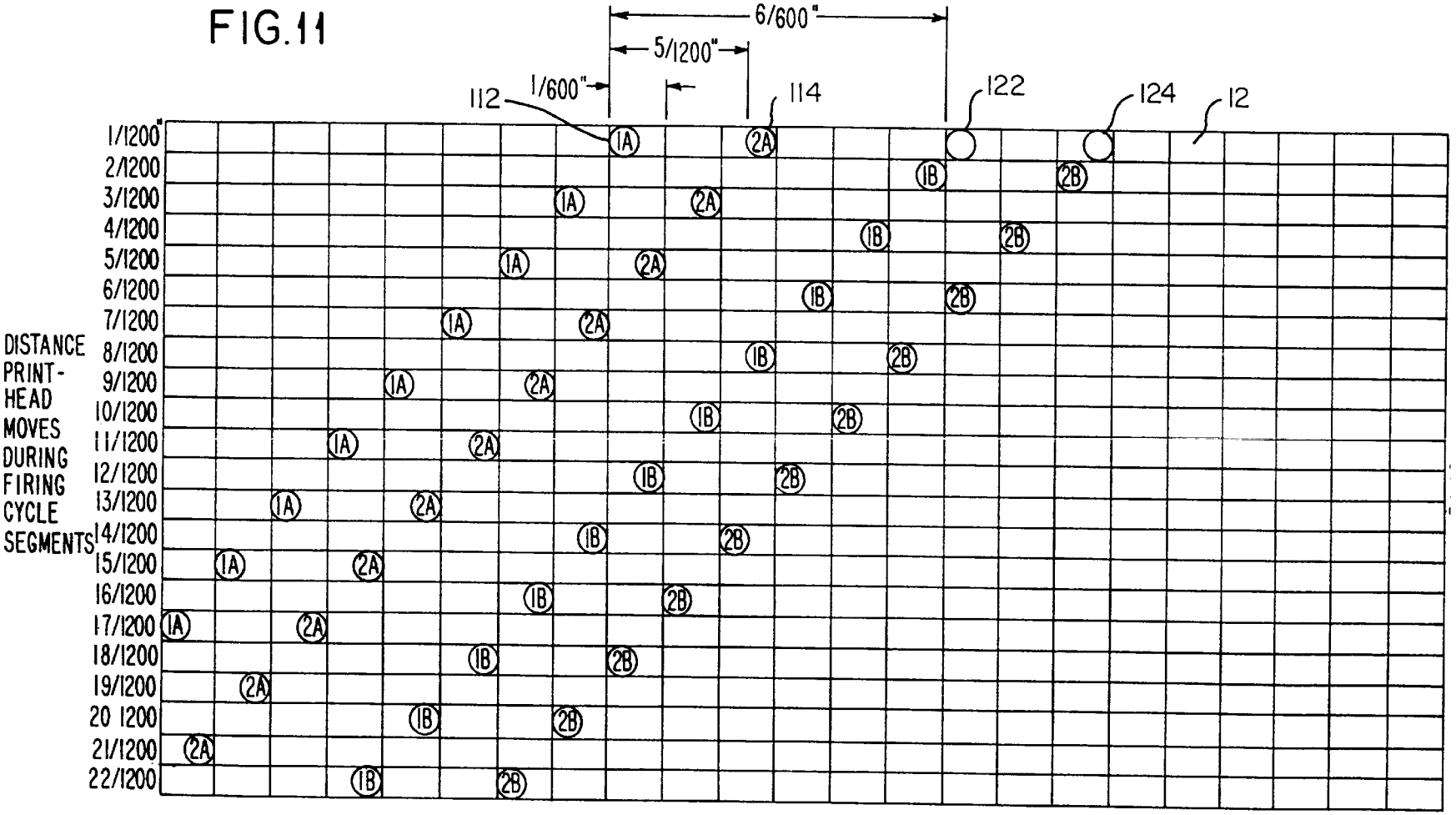
FIG. 11 is a plot showing dots generated by first, second, third and fourth nozzles during consecutive segments of normal speed mode firing cycles.

In FIG. 11, a plot is illustrated showing dots generated by a first nozzle 112, a second nozzle 114, a third nozzle 122 and a fourth nozzle 124 during normal speed mode operation. The initial positions of the nozzles 112, 114, 122 and 124 are shown. Dots generated by the nozzles 112,114, 122 and 124 are represented by numbered circles, wherein dots 1A are formed by the first nozzle 112, dots 2A are formed by the second nozzle 114, dots 1B are formed by the third nozzle 122 and dots 2B are formed by the fourth nozzle 124. As can be seen from FIG. 11, during a first segment 602*a* of a normal speed mode firing cycle, nozzles 112 and 114 are fired and the printhead moves a distance across the paper substrate 12 equal to 1/1200 inch. During a second segment 602*b* of the normal speed mode firing cycle, nozzles 122 and 124 are fired and the printhead moves another 1/1200 inch across the paper substrate 12. During a third segment 602*c* of the normal speed firing cycle, nozzles 112 and 114 are fired and the printhead moves another 1/1200 inch across the paper substrate 12. During a fourth segment 602*d* of the high speed firing cycle, nozzles 122 and 124 are fired and the printhead moves another 1/1200 inch across the paper substrate 12. As is apparent from FIG. 11, the dots created by the nozzles 112, 114, 122 and 124 are positioned on a 1200 dots per inch horizontal grid. A 1200 dots per inch resolution is possible along a vertical direction by appropriate control of the stepper motor assembly 19 by the microprocessor 310.

It is further contemplated that instead of having a single nozzle plate 54 coupled to a single heater chip 50 including both the primary and secondary nozzles 110 and 120, two separate printheads positioned side-by-side, one including the primary nozzles and the other having the secondary nozzles, may be used.

What is claimed is:

1. An ink jet printhead comprising:

a heater chip; and a nozzle plate coupled to said heater chip and having a plurality of primary and secondary nozzles formed therein, said primary nozzles including first and second nozzles positioned in first and second nozzle plate columns and said secondary nozzles including third and fourth nozzles positioned in third and fourth nozzle plate columns wherein each of said third nozzles shares a same horizontal axis with each of said first nozzles, and wherein each of said fourth nozzles shares a same horizontal axis with each of said second nozzles thereby defining said secondary nozzles as redundant to said primary nozzles.

2. An ink jet printhead as set forth in claim 1, wherein said first and second columns are spaced apart from one another by a distance equal to X/1200 inch, wherein X is an odd integer ≧3 and ≦9.

3. An ink jet printhead as set forth in claim 2, wherein said third and fourth columns are spaced apart from one another by a distance equal to X/1200 inch, wherein X is an odd integer ≧3 and ≦9.

4. An ink jet printhead as set forth in claim 3, wherein said first and third columns are spaced apart from one another by a distance equal to Y/600 inch, wherein Y is an even integer ≧40.

5. An ink let printhead as set forth in claim 1, wherein said first and third columns are spaced apart from one another by a distance equal to Y/600 inch, wherein Y is an even integer ≧40.

6. An ink jet printhead as set forth in claim 1, wherein said second nozzles are staggered relative to said first nozzles and said fourth nozzles are staggered relative to said third nozzles.

7. An ink jet printhead as set forth in claim 6, wherein the vertical distance between adjacent first and second nozzles is approximately 1/600 inch.

8. An ink jet printhead as set forth in claim 7, wherein the vertical distance between adjacent first nozzles is approximately 1/300 inch.

9. A ink jet printing apparatus comprising:

a print cartridge including a heater chip and a nozzle plate coupled to said heater chip, said heater chip having first, second, third and fourth heating elements, and said nozzle plate having a plurality of primary and secondary nozzles, said primary nozzles including first and second nozzles positioned in first and second nozzle plate columns and said secondary nozzles including third and fourth nozzles positioned in third and fourth nozzle plate columns, each of said nozzles having one of said heating elements associated therewith for generating energy to discharge ink therefrom wherein each of said third nozzles shares a same horizontal axis with each of said first nozzles, and wherein each of said fourth nozzles shares a same horizontal axis with each of said second nozzles thereby defining said secondary nozzles as redundant to said primary nozzles; and a driver circuit, electrically coupled to said print cartridge, for applying firing pulses to said heating elements.

10. An ink jet printing apparatus as set forth in claim 9, wherein said first and second columns are spaced apart from one another by a distance equal to X/1200 inch, wherein X is an odd integer ≧3 and ≦9.

11. An ink jet printing apparatus as set forth in claim 10, wherein said third and fourth columns are spaced apart from one another by a distance equal to X/1200 inch, wherein X is an odd integer ≧3 and ≦9.

12. An ink jet printing apparatus as set forth in claim 11, wherein said first and third columns are spaced apart from one another by a distance equal to Y/600 inch, wherein Y is an even integer ≧40.

13. An ink jet printing apparatus as set forth in claim 9, wherein said first and third columns are spaced apart from one another by a distance equal to Y/600 inch, wherein Y is an even integer ≧40.

14. An ink jet printing apparatus as set forth in claim 9, wherein said second nozzles are staggered relative to said first nozzles and said fourth nozzles are staggered relative to said third nozzles.

15. An ink let printing apparatus as set forth in claim 14, wherein the vertical distance between adjacent first and second nozzles is approximately 1/600 inch.

16. An ink jet printing apparatus printhead as set forth in claim 15, wherein the vertical distance between adjacent first nozzles is approximately 1/300 inch.

17. An ink jet printing apparatus as set forth in claim 9, wherein said driver circuit is selectively operable in one of a normal mode of operation and a high speed mode of operation.

18. An ink let printing apparatus as set forth in claim 9, wherein said first nozzles are associated with said first heating elements, said second nozzles are associated with said second heating elements, said third nozzles are associated with said third heating elements and said fourth nozzles are associated with said fourth heating elements.

19. An ink jet printing apparatus as set forth in claim 18, wherein said driver circuit alternatively applies firing pulses to said first and second heating elements during a first segment of a normal mode firing cycle and alternatively applies firing pulses to said third and fourth heating elements during a second segment of said normal mode firing cycle.

20. An ink jet printing apparatus as set forth in claim 19, wherein the length of time of each of said first and second segments of said normal mode firing cycle is from about 24 μseconds to about 64 μseconds.

21. An ink jet printing apparatus as set forth in claim 18, wherein said driver circuit applies first firing pulses to said first heating elements during a first segment of a high speed mode firing cycle, second firing pulses to said second heating elements during a second segment of said high speed mode firing cycle, third firing pulses to said third heating elements during a third segment of said high speed mode firing cycle, and fourth firing pulses to said fourth heating elements during a fourth segment of said high speed mode firing cycle.

22. An ink jet printing apparatus as set forth in claim 21, wherein the length of time of each of said first, second, third and fourth segments of said high speed mode firing cycle is from about 12 μseconds to about 64 μseconds.

23. A nozzle plate adapted to be coupled to a heater chip so as to form an ink jet printhead, said nozzle plate comprising:

a substrate having a plurality of primary and secondary nozzles formed therein, said primary nozzles including first and second nozzles positioned in first and second nozzle plate columns and said secondary nozzles including third and fourth nozzles positioned in third and fourth nozzle plate columns wherein each of said third nozzles shares a same horizontal axis with each of said first nozzles, and wherein each of said fourth nozzles shares a same horizontal axis with each of said second nozzles thereby defining said secondary nozzles as redundant to said primary nozzles.

24. A nozzle plate as set forth in claim 23, wherein said first and second columns are spaced apart from one another by a distance equal to X/1200 inch, wherein X is an odd integer ≧3 and ≦9.

25. A nozzle plate as set forth in claim 24, wherein said third and fourth columns are spaced apart from one another by a distance equal to X/1200 inch, wherein X is an odd integer ≧3 and ≦9.

26. A nozzle plate as set forth in claim 25, wherein said first and third columns are spaced apart from one another by a distance equal to Y/600 inch, wherein Y is an even integer ≧40.

27. A nozzle plate as set forth in claim 23, wherein said first and third columns are spaced apart from one another by a distance equal to Y/600 inch, wherein Y is an even integer ≧40.

28. A nozzle plate as set forth in claim 23, wherein said second nozzles are staggered relative to said first nozzles and said fourth nozzles are staggered relative to said third nozzles.

29. A nozzle plate as set forth in claim 28, wherein the vertical distance between adjacent first and second nozzles is approximately 1/600 inch.

30. A nozzle plate as set forth in 29, wherein the vertical distance between adjacent first nozzles is approximately 1/300 inch.

* * * * *